US007243515B2

(12) United States Patent
Meyer

(10) Patent No.: US 7,243,515 B2
(45) Date of Patent: Jul. 17, 2007

(54) LOCKING MECHANISM

(76) Inventor: Carl Meyer, 83 Maluti Avenue, Northcliff X25, Randburg, 2125 (ZA)

( * ) Notice: Subject to any disclaimer, the term of this patent is extended or adjusted under 35 U.S.C. 154(b) by 0 days.

(21) Appl. No.: 11/057,382

(22) Filed: Feb. 15, 2005

(65) Prior Publication Data

US 2006/0053849 A1 Mar. 16, 2006

Related U.S. Application Data

(63) Continuation of application No. PCT/ZA03/00113, filed on Aug. 15, 2003.

(30) Foreign Application Priority Data

Aug. 15, 2002 (ZA) ..... 02/6521

(51) Int. Cl.
*E05B 43/00* (2006.01)

(52) U.S. Cl. ..... 70/269; 70/168; 70/163; 404/25

(58) Field of Classification Search ..... 70/158–169, 70/267–269; 404/25
See application file for complete search history.

(56) References Cited

U.S. PATENT DOCUMENTS 4,148,092 A * 4/1979 Martin ..... 361/172
4,854,076 A * 8/1989 Sieben et al. ..... 49/280
6,199,414 B1 * 3/2001 Chang ..... 70/168
6,435,763 B1 * 8/2002 Sakane et al. ..... 404/25
6,768,675 B1 * 7/2004 Huang ..... 365/185.17
6,952,996 B2 * 10/2005 Sisk et al. ..... 105/377.01
2005/0099262 A1 * 5/2005 Childress et al. ..... 340/5.6
2005/0232695 A1 * 10/2005 Meyers ..... 404/25

FOREIGN PATENT DOCUMENTS

| | | |
|---|---|---|
| DE | 10021839 A1 | 11/2000 |
| DE | 19939628 A1 | 2/2001 |
| EP | 1048806 A2 | 11/2000 |
| FR | 2736663 A1 | 1/1997 |
| GB | 20817 | 9/1913 |
| GB | 13910 | 9/1915 |

* cited by examiner

*Primary Examiner*—Suzanne Dino Barrett
(74) *Attorney, Agent, or Firm*—Jones, Tullar & Cooper, P.C.

(57) ABSTRACT

A locking mechanism which includes a locking member which is movable between a locked position and an unlocked position, a retaining device which is movable between a first position at which movement of the locking member from the locked position to the unlocked position is prevented and a second position at which movement of the locking member from the locked position to the unlocked position is allowed, and an actuator for moving the retaining device between the first and second positions.

5 Claims, 5 Drawing Sheets

LOCKING MECHANISM

CROSS REFERENCE TO RELATED APPLICATIONS

This application is a continuation under 35 U.S.C. §120 and 365(c) of International Application No. PCT/ZA2003/00113, which was filed on Aug. 15, 2003 and designates the Untied States.

BACKGROUND OF THE INVENTION

This invention relates to a locking mechanism. The invention is described hereinafter with reference to a locking of a manhole cover but it is to be understood that this is merely by way of a non-limiting example. Other applications abound, eg. the locking of doors fixed to cabinets, containers, strong rooms and the like.

Manholes provide access to tunnels and passages which are used for vital components and services such as communication cables, electricity supplies, water and gas pipes and the like. If a manhole is breached and access is gained to this type of equipment the consequences can be serious.

It is known to lock a manhole cover to a surrounding frame. The lock which is used should, as far as is possible, be tamperproof. The frequency with which the lock is used, ie. locked and unlocked, may be high or low, depending on the circumstances. In many instances though a manhole cover will remain locked for a considerable period. The environmental conditions to which a manhole cover is exposed may also be severe and the cover may be subjected to a wide temperature range, the full effects of the weather eg. rain and snow, traffic and the like.

In explosive or hazardous environments the cover and the lock may also be required to be intrinsically safe.

It is apparent therefore that the provision of a lockable and secure manhole cover which is tamper-resistant and able to withstand a wide range of operating conditions is a challenging task.

SUMMARY OF INVENTION

The invention provides a locking mechanism which includes a locking member which is movable between a locked position and an unlocked position, a retaining device which is movable between a first position at which movement of the locking member from the locked position to the unlocked position is prevented and a second position at which movement of the locking member from the locked position to the unlocked position is allowed, and an actuator for moving the retaining device between the first and second positions.

The actuator is preferably electrically movable. Use may be made of any appropriate means for moving the actuator such as a servo-motor, a stepper motor, a geared motor, a worm screw or a solenoid. Preferably the actuator is responsive to a signal which must be correctly encoded in order to cause movement or operation of the actuator.

The locking mechanism may therefore include a signal identification means such a receiver, which may include a decoder and which detects an externally transmitted signal and, if the signal is verified, causes the actuator to operate.

The mechanism may include a timer which commences a timing period when the retaining device is moved from the first position to the second position. If, during the timing period, the locking member is not moved to the unlocked position then the timer may automatically cause the actuator to move the retaining device from the second position to the first position. Thus a time window is opened when a correctly encoded signal is received and the locking member must be moved within this time window failing which the time window is closed.

In one form of the invention the locking member is in the nature of a bolt which is slidable between the locked and unlocked positions. In the unlocked position the bolt may be subject to a biasing force which tends to move the bolt to the locked position.

In a variation of the invention the locking member is pivotally movable between the locked and unlocked positions.

The retaining device may be movable to obstruct the sliding or pivotal movement of the locking member.

A catch may be provided to keep the bolt in the unlocked position.

In a different form of the invention the locking member is mounted to a shaft for at least limited rotational movement. In one example of the invention the locking member is rotatable relatively to the shaft and the retaining device may be movable by the actuator between the first position at which the retaining device engages with the shaft or the locking device and prevents movement of the locking member relatively to the shaft and the second position at which the retaining device disengages from the shaft or the locking device, as the case may be, and permits limited rotational movement of the locking member.

In a second example of the invention the locking member is fixed to the shaft and the retaining device is movable into engagement with, or out of engagement from, the locking device or the shaft, thereby to control movement of the locking member.

The locking member may be in the nature of a body which includes a hollow interior in which are mounted the actuator, the retaining device and an electrical energy source such as a battery.

The retaining device may be mounted for sliding movement inside a formation in the body. The retaining device may be reciprocal within the formation.

The actuator may be responsive to a control circuit The control circuit may include a code, which may be variable, which is used to validate an input to the control circuit.

The body may include at least two interengageable parts with one or more cavities or recesses formed inside at least one of the parts to accommodate the retaining device, the actuator and the control circuit. The body may have attached to it, or be shaped to include, a locking formation. The locking formation may be in the nature of a hook. In a preferred form of the invention the hook formation is integrally formed in the body.

The retaining device may run on low friction devices inside the body. Preferably use is made of ball bearings in this regard.

The shaft may be fixed to structure which is not movable so that the body is rotationally movable, to a limited extent, relatively to such structure.

The locking mechanism may be used for locking a door, closure or other similar movable component relatively to a frame.

The invention further extends to a door in combination with a locking mechanism of the aforementioned kind, the shaft being attached to, or being immovable relatively to, the door and the body of the locking mechanism being movable, to a limited extent, relatively to the door. The door may be mounted for engagement with, and disengagement from, a frame.

In a preferred form of the invention the door is in the nature of a manhole cover which is engageable with, and which is lockable by means of the locking mechanism to, the frame.

Depending on the orientation of the body, relatively to the manhole cover, the combination may include a biasing member for biasing the body relatively to the manhole cover towards the aforementioned unlocked position.

BRIEF DESCRIPTION OF THE DRAWINGS

The invention is further described by way of examples with reference to the accompanying drawings in which.

DESCRIPTION OF PREFERRED EMBODIMENTS

Figure 1:
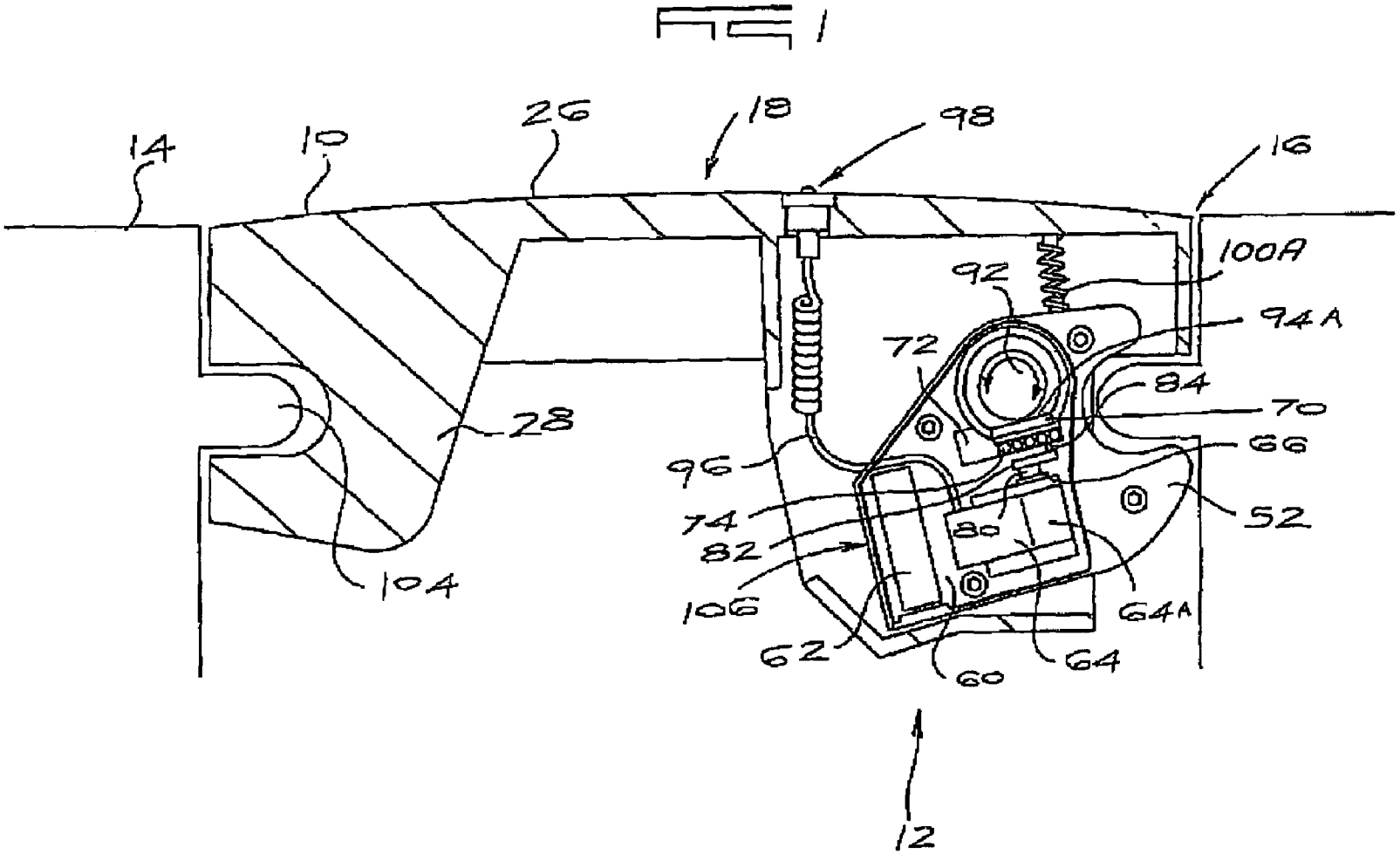
FIG. 1 is a side view, partly sectioned, of a manhole cover which includes a locking mechanism according to a first form of the invention engaged with a manhole frame.
Figure 2:
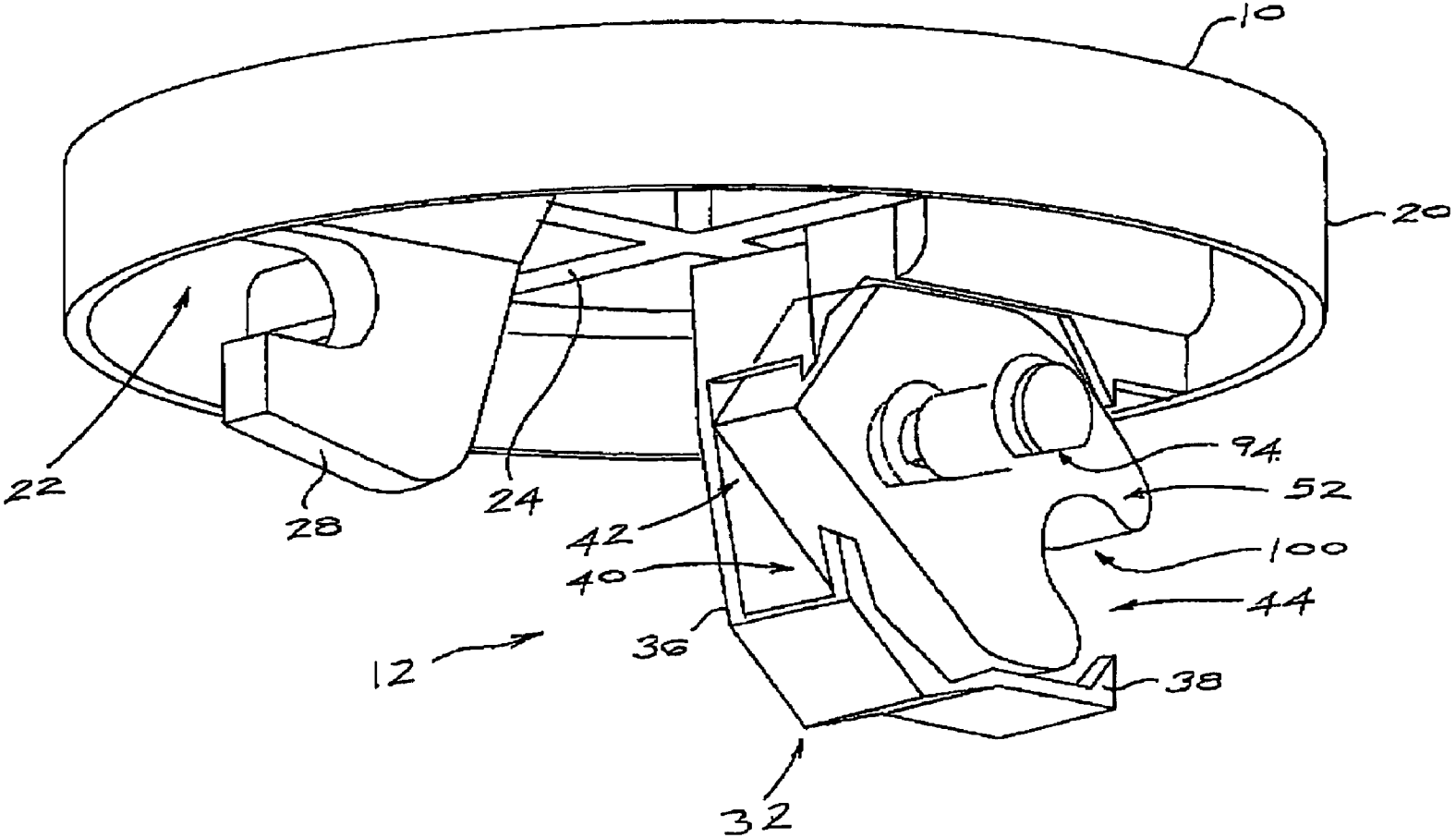
FIG. 2 is a perspective view from below of the manhole cover of FIG. 1.

FIGS. 1 and 2 of the accompanying drawings illustrates a manhole cover 10 to which is fitted a locking mechanism 12. In FIG. 1 the manhole cover is shown engaged with a manhole frame 14.

The manhole cover 10 is made from any suitable material such as high grade stainless steel, hot dipped galvanised mild steel, or spheroidal graphite preferably using a casting process. The cover is made to any appropriate shape and size and, in most instances, in plan is round or square.

The manhole cover is dome-shaped and increases in height from a periphery 16 to a centre position 18. The periphery is defined by means of a downwardly extending rim 20. An underside 22 of the cover is recessed and, where required, includes a plurality of reinforcing formations or ribs 24.

An upper surface 26 of the cover is corrugated or ribbed to provide an anti-slip surface.

A hook formation 28 is integrally formed with the cover. The hook 28 is close to the rim 20 and extends downwardly from the cover.

Structure 32 is formed on a lower side of the manhole cover, more or less diametrically opposed to the hook 28, and also extends downwardly. The structure 32 forms a housing which has side walls 36 and 38 which bound a cavity 40. An opening 42 is defined on one side of the housing, between the side walls 36 and 38, and a somewhat larger opening 44 is similarly formed on an opposing side of the housing.

The locking mechanism 12 is mounted inside the cavity 40. The locking mechanism has a body 52 which is made from two steel blocks 54 and 56 respectively which are secured to each other by means of a plurality of security bolts 58. A cavity 60 is formed by opposed recesses in opposed mating surfaces of the blocks when they are engaged with each other. Mounted inside the cavity are a battery 62, a control circuit 64 which is carried on a PC board, a servo-motor 66 and a retaining device or catch 70. The control circuit includes a programmable non-volatile memory 64A in which is stored a code. The code may be uniquely associated with a single locking device or manhole cover, or with a plurality of locking devices, according to predetermined criteria.

The catch is positioned inside a linear recess 72 and is mounted for sliding movement to and fro, on a plurality of ball bearings 74. In FIG. 1 ball bearings 74 are shown engaged with one face only of the catch but is to be understood that an opposed face of the catch is similarly supported by means of ball bearings.

The servo-motor has a shaft 80 which projects from its housing. An arm 82 is mounted to the shaft and a pin 84 projects from the shaft. The pin is positioned inside a groove in a side surface of the catch.

Figure 3:
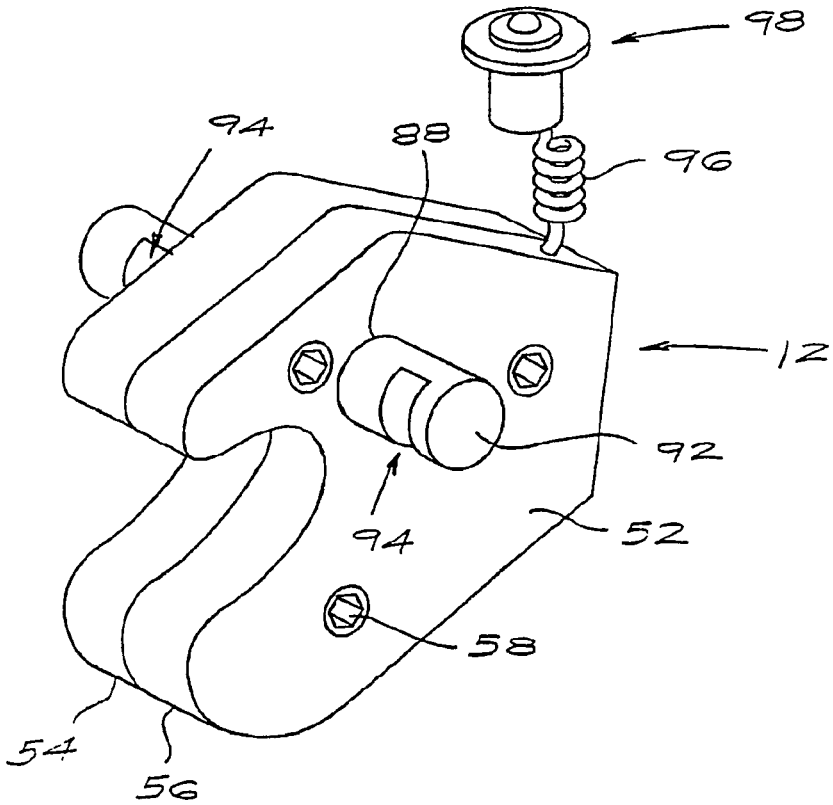
FIG. 3 is a perspective view of the locking mechanism shown in FIG. 1.

Each block 54 and 56 is formed with a respective circular hole 88. Only the hole in the block 56 is shown in FIG. 3. When the blocks 54 and 56 are engaged with each other the holes are in register. A shaft 92 extends through the holes 88. The shaft is nominally circular but it is formed with a number of flat surfaces 94 at selected locations.

The shaft is mounted to opposed openings formed in the side walls 36 and 38 and is positioned so that two of the flat surfaces 94 on the shaft are respectively engaged with corresponding flat formations which help to define the openings in the side walls. The shaft is securely fixed to the structure 32 and is prevented from rotating relatively to the structure by the interengaged flat surfaces and formations. On the other hand the body 52 can rotate to a limited extent about the shaft.

A flexible control lead 96 extends from the control circuit 64 to a stainless steel contact point 98 which is mounted to the cover 10 and which is visible and accessible from an upper side of the cover. The contact point 98 is electrically isolated from the cover 10.

The blocks 54 and 56 are shaped so that, when engaged with each other, they define a hook formation 100 which is substantially similar to the hook formation 28.

The servo-motor 66 is designed to move the retaining device or catch 70, in a controlled manner, to and fro inside the recess 72. If the catch 70 is moved to a limiting left-hand position, away from the position shown in FIG. 1, then the catch 70 is disengaged from the shaft 92 and the blocks 54 and 56, which make up the body 52 of the locking mechanism, are rotatable about the shaft 92 to a limited extent. On the other hand if the catch 70 is moved to a right-hand position, as is shown in FIG. 1, the catch engages with a predetermined flat surface 94A on the shaft and the body is then securely fixed to the shaft and is non-rotatable.

A robust spring 100A, of any appropriate type, is fixed to an undersurface of the manhole cover and acts on an upper surface of the body of the locking mechanism. When the body is in the position shown in FIG. 1 the spring 100 is compressed. When the catch is moved to the left-hand position inside the recess 72, as described, the spring expands and causes the body to rotate in a clockwise direction (referring to FIG. 1), to a limited extent about the shaft. The hook formation 100 is thereby moved to a downwardly facing orientation, as shown in FIG. 2.

The frame 14 has a complementary shape to the cover 10 and includes a circumferential peripheral inwardly extending projection 104.

Assume that the catch 70 is moved to the left-hand position in the recess 72. The body of the locking mechanism then pivots downwardly about the shaft 92. The hook formation 28 can then be engaged with a portion of the projection 104, with the cover 10 in a tilted or inclined position. As the cover is lowered onto the frame 14 the hook formation 100 in the body engages with the projection 104 on a diametrically opposed side of the frame and the body is moved to the position shown in FIG. 1. If the catch 70 is then moved to the right the catch engages with the corresponding flat surface 94 on the shaft and this prevents free rotation of the body relatively to the shaft. The manhole cover is thereby locked to the frame.

The two blocks 54 and 56 are formed with elongate channel formations in opposed mating surfaces which house an elongate, flexible and resiliently compressible seal 106. Consequently when the blocks are fixed to one another by means of the bolts 58 the cavity inside the body which contains the battery, control circuit, servo-motor and catch, is effectively sealed against the environment in which the locking mechanism is used. The seal is water-and dust-proof and ensures that the components inside the body 52 are protected against adverse factors.

It is possible to mount the servo-motor outside the body eg. so that it moves with the body and is still able to actuate the retaining device. Also, the servo-motor, in either position, can be replaced by a solenoid which imparts to the retaining device the required sliding movement.

Figure 6:
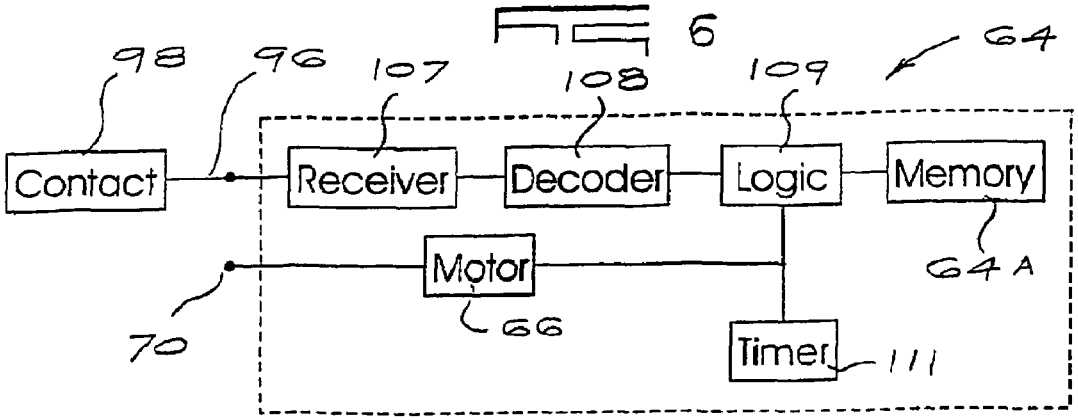
FIG. 6 is a block diagram of a circuit used to control the operation of the locking mechanism of the invention.

FIG. 6 is a block diagram representation of the circuit 64 which includes a receiver 107 to which the lead 96 is connected, a decoder 108, a logic unit 109 which includes the non-volatile memory 64A in which is stored the unique code allocated to the locking mechanism, and a timer 111.

The control circuit 64 controls the operation of the locking mechanism. In the absence of an input at the point 98 the control circuit automatically goes into a "sleep" mode in which the circuit draws a small current only from the battery. If an electronic key is presented to the contact point 98 then the control circuit goes into an active or operational mode. A signal which is input via the contact point, in order to operate the locking mechanism, is in encoded form. The signal is received and decoded by the receiver 107 and decoder 108 and the decoded signal is compared by the logic unit 109 to the code which is stored in the memory 64A for verification purposes. If the input code is validated then the control circuit causes the servo-motor 66 to be driven by the battery and the catch 70 is moved to a locking position, or a release or unlocked position as the case may be, according to requirements.

The code which is contained in the memory 64A may be varied in a manner which is known in the art and, for this purpose, use may be made of code hopping or similar techniques.

The manhole cover and the locking mechanism are, for all practical purposes, tamper-proof. The low operating power requirement of the electronic components of the locking device means that the power supply lifetime is of the order of several years. In this connection it is to be noted that use is made of a long life battery 62, for example of the lithium-type.

The contact point 98 provides a touch read/write interface through which all necessary information and data required for operating the locking mechanism can be transferred to the control circuit.

The manhole cover and locking mechanism are preferably used in combination with an electronic key (not shown) which carries its own power supply and a display. The electronic key is preferably only programmable by an authorised person using a designated computer interface. The key can be programmed using techniques which are known in the art for daily, weekly or monthly use and the number of openings and closings of manhole covers can be specified. Also, by assigning a unique identity number to each manhole cover, the use of the electronic key can be restricted to gaining access only to authorised or designated manhole covers.

The key can be programmed in such a way that it can be used only by a designated group or person. This means that if an individual is using the key that person is only able to work on one manhole at a time and can only open a successive manhole cover when a preceding cover has been put into a locked mode. It is also possible to control the use of the electronic key on a time basis. This means that the opening or closing of manhole covers will only be permitted during a specified time, for example during normal working hours and weekdays.

Figure 7:
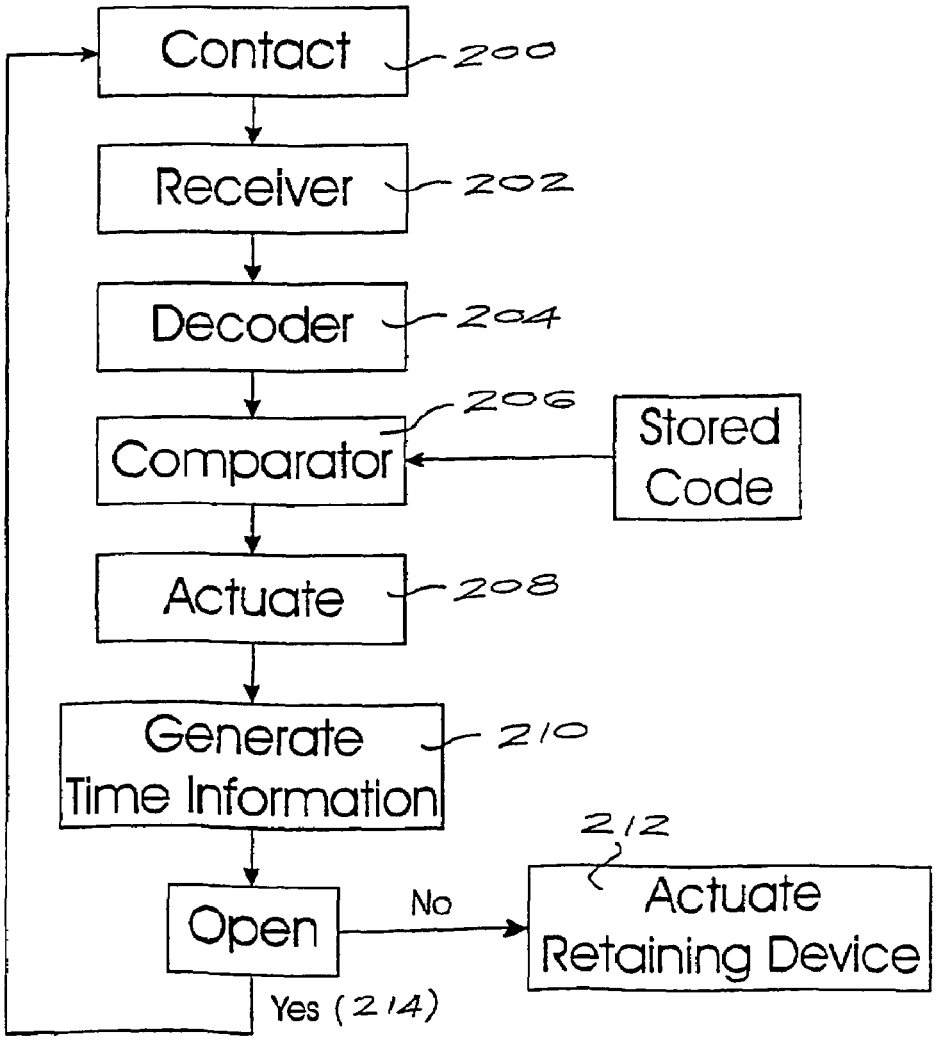
FIG. 7 is a simplified flow chart of a sequence of operations of the locking mechanism.

FIG. 7 shows a typical sequence of operations when using the locking mechanism. When the contact 98 detects a signal (200) the receiver 107 processes the signal (202) and applies the output (step 204) to the decoder 108. The logic unit 109 compares the stored code to the received code (step 206) and if the latter code is confirmed, generates a signal (step 206) to drive the servo-motor 66 (208). The timer signals the time (210) at which this step occurs. If the cover is not opened (212) within a predetermined time the logic unit actuates the motor to move the retaining device so that the cover cannot be opened. If the cover is opened (214) within this time interval the system is reset (212) and the receiver and logic unit again await a signal from the contact point 98.

Figure 4:
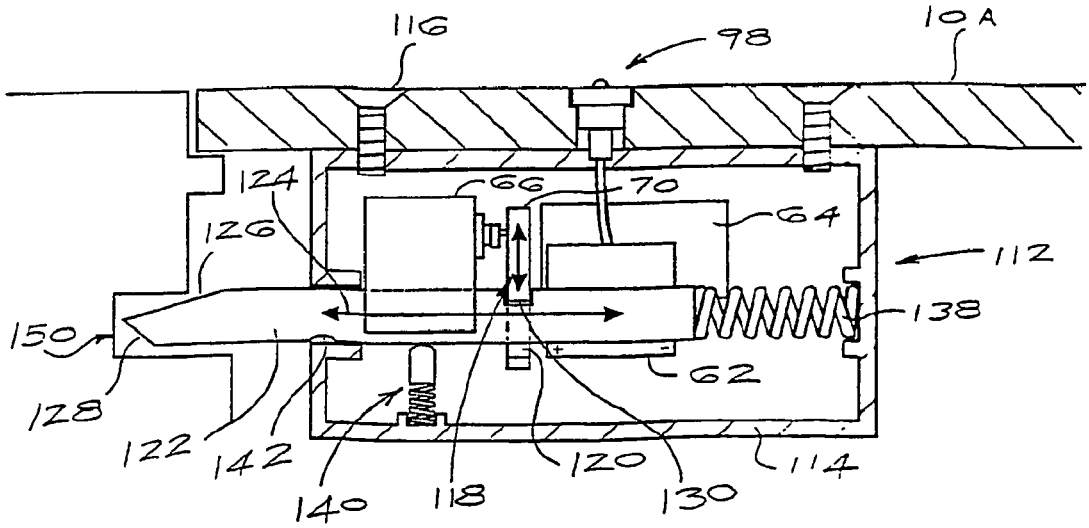
FIG. 4 is a side view of a locking mechanism according to a second form of the invention.

FIG. 4 illustrates a locking mechanism 112 according to a second form of the invention which is particularly suitable for use with an existing manhole cover 10A and can be added relatively easy to most manhole covers of known design.

The mechanism includes a housing 114 with a stainless steel contact point 98, which is similar to that described in connection with the first embodiment of the invention, on an upper surface of the housing. Fixing screws 116 are also provided on the upper surface.

In order to attach the housing to an existing manhole cover three holes are formed in the cover. The contact point 98 is fitted to one hole and the mounting screws 116 to the other holes. These devices are such that once they are tightened and engaged, with a screw fit, with the housing 114 they cannot be counter-rotated. In this way a secure fixing of the housing to an under surface of the manhole cover 10A is achieved. Mounted inside the housing 114 are batteries 62, a control circuit 64, with a memory 64A, carried on a PC board, a servo-motor 66 and a retaining device or catch 70 which is movable by the servo-motor. These components are generally similar in concept to what has been described in connection with the first embodiment of the invention.

The retaining device 70 is mounted so that it can be moved, with a sliding action, in the direction of a double-headed arrow 118 by the actuator 66. This movement takes place against the action of a biasing spring, not shown. The retaining device 70 is in the nature of a plate and it is formed with an aperture or cutout 120.

A bolt 122 is mounted for sliding movement in a direction 124 which is transverse to the direction in which the retaining device is movable. A protruding end of the bolt has two inclined surfaces 126 and 128 respectively which form a pointed formation. When the retaining device 70 is at a lowermost position a solid portion thereof is engaged with a slot 130 in the bolt and this prevents sliding movement of the bolt. If the retaining device is moved upwardly to a limiting position then the plate is disengaged from the bolt which can then be moved to the right. This sliding action, when it takes place, is against the biasing action of a spring 138.

A spring-loaded catch 140 is engageable with a slot or groove 142 in the bolt when the bolt is at a right hand limiting position.

The operation of the locking mechanism 112 is in many respects similar to that of the locking mechanism 12. When the locking mechanism is attached to a manhole cover the bolt 122, as it protrudes from the housing 114, is engageable with a formation 150 in a frame in which the manhole cover is mounted. The bolt cannot be retracted while the retaining device 70 is in its lower position. If an electronic key is engaged with the contact 98 and a correctly encoded signal is detected by the board 64 then the actuator 66 is energised, via the battery 62, and the retaining device 70 is elevated against the action of the spring referred to. A timing device, which is located on the board 64, initiates a timing interval of, say, 30 seconds. If the manhole cover is lifted during the timing interval then the sloping upper surface 126 of the bolt strikes an opposing surface of the formation 150 and the bolt 122 is thereby forced into the housing 114. The bolt is moved to a point at which the spring-loaded catch 140 engages with the formation 142 and the bolt is thereby kept in the retracted or unlocked position.

If the manhole cover is not disengaged from the frame during the timing interval the timer automatically causes the actuator 66 to operate and the retaining device is then restored to the lower position in which movement of the bolt is prevented.

When the cover is re-engaged with the frame the lower inclined surface 128 strikes a surface of the formation 150. In so doing, the bolt is moved deeper into the housing, against the action of the spring 138 and the spring loaded catch 140 then disengages from the formation 142. Once the bolt is aligned with the formation 150 the spring 138 forces the bolt to the left, to its locked position. The speed of movement is such that the catch 140 does not re-engage with the formation 142 and the bolt is therefore driven fully home to the locked position. The electronic key is thereafter engaged with the contact point 98 whereupon the actuator is energised so that the retaining device 70, which is in the nature of a dead bolt, moves downwardly to prevent further movement of the bolt 122.

With this form of the invention the bolt 122 can have a small wheel rotatably fixed to its protruding end. The wheel fulfils the same functions as the inclined surfaces 126 and 128, but is less likely to get jammed as the cover is opened and closed.

In the first embodiment use is made of a servo-motor, inside the body of the locking member, to control its locking operation. In the second embodiment, shown in FIG. 4, the locking member is slidably movable with control being exercised by means of a servo-motor. In each instance the servo-motor could be replaced by any actuator eg. of the kind referred to hereinbefore, and particularly by a solenoid device. Also, irrespective of the nature of the actuator, and referring particularly to the first embodiment, the actuator could be outside the body of the locking member.

Figure 5:
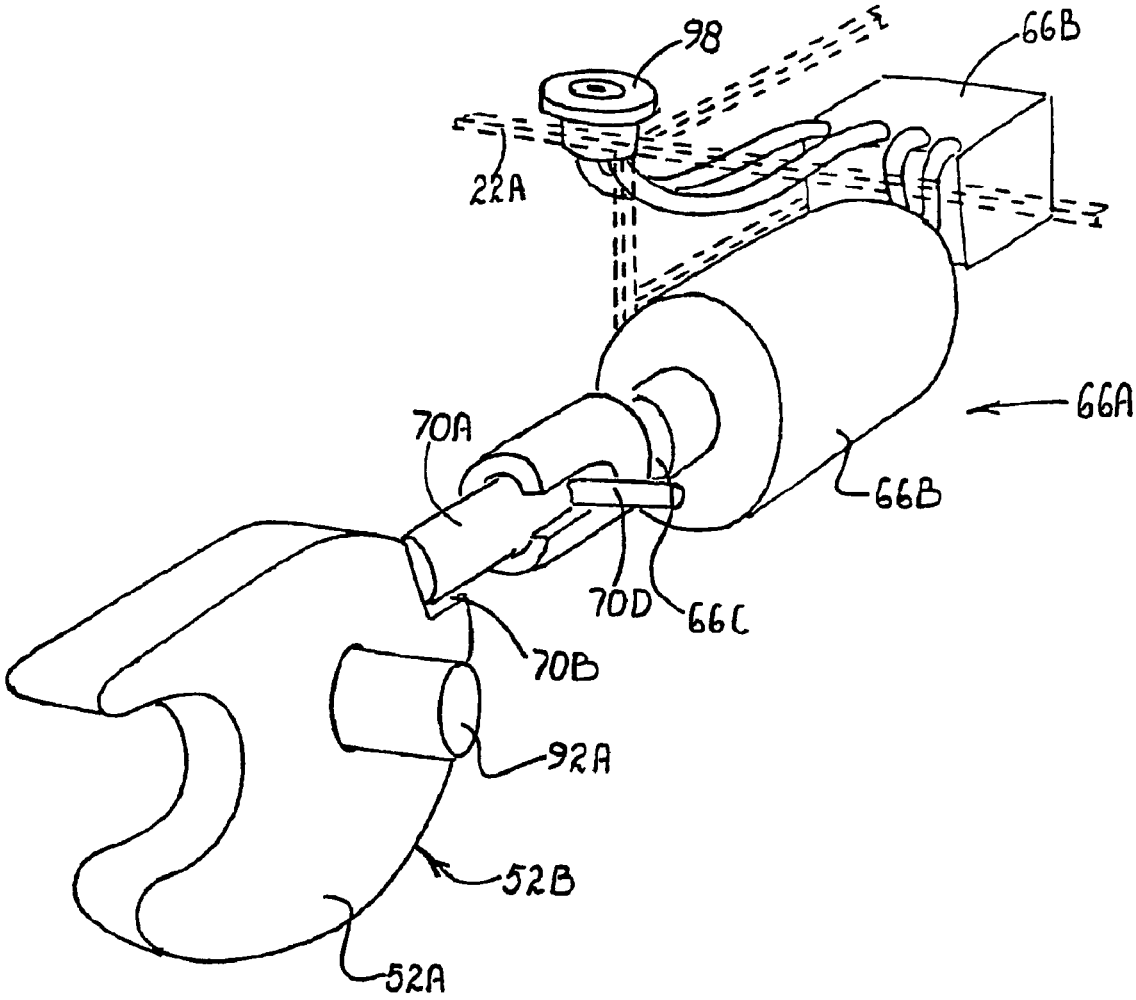
FIG. 5 illustrates a locking mechanism according to another form of the invention.

FIG. 5 shows a solid locking member body 52A which is made from steel and which is mounted to a shaft 92A. The body could be fixed to the shaft so that it is rotatable in unison with the shaft or it could be rotatable relatively to the shaft.

An actuator 66A in the form of a solenoid 66B is mounted to fixed structure 22A of a manhole cover shown in dotted lines, adjacent the body 52A. A plunger 66C of the solenoid extends towards the body and is fixed to a retaining pin 70A which fits into a recessed formation 70B on an outer side of the body. A control circuit 64B which includes the components shown in FIG. 5 (except that the motor 66 is replaced by the solenoid) is connected to a contact 98 and is used to control movement of the solenoid. If the plunger is retracted the pin 70A is remote from the body which can then rotate, according to requirement, about the shaft or with the shaft, as the case may be. On the other hand when the plunger is extended the pin engages with the body, as illustrated, and prevents rotation of the body. The locking member is then kept in the position shown in FIG. 5 which is the locked position.

Normally the solenoid must be energized to release the body and, in the non-energized state, the solenoid allows the body to rotate in a manner which is similar to what has been described in connection with the first embodiment. A spring, not shown, biases the plunger outwardly away from the housing of the solenoid so that positive locking action is always achieved. Also, the body 52A has a curved surface 52B which provides a smooth guide for the retaining pin, if it should come into contact with the surface 52B, which does not impede rotational movement of the body 52A.

A short rod 70D is fixed to the plunger to allow for manual operation of the locking mechanism from inside the manhole. This is a safety feature.

The structure 22A, shown in dotted outline, can be shaped as required to protect the body 52A and the solenoid 66B, as required.

It is possible to replace the solenoid with a servo-motor to provide the required degree of sliding movement of the retaining pin.

The features of control, operator or manhole cover identity, authorisation of use, and the like, can be implemented with either form of the invention. Thus it is possible to log the time at which an operator, if authorised, opens a manhole cover and the time at which the operator closes the manhole cover. A succeeding manhole cover cannot be opened unless a preceeding manhole cover has been properly locked. All of this information is logged in a memory carried on a mobile key and at the end of a working day the information is downloaded to a control computer and, at the same time, the information on the following day's work which the operator is permitted and expected to carry out is transferred to the electronic key.

The invention claimed is:

1. A locking mechanism which includes a locking member comprising a body with a hollow interior, and an actuator, a retaining device and an electrical energy source which are mounted within the hollow interior, the actuator being movable by the electrical energy source, wherein the locking member is mounted to a shaft for at least limited rotational movement and is movable between a locked position and an unlocked position, the retaining device being movable by the actuator between a first position at which the retaining device engages with at least one of the shaft and the locking member and prevents rotational movement of the locking member from the locked position to the unlocked position, and a second position at which the retaining device permits limited rotational movement of the locking member from the locked position to the unlocked position.

2. A locking mechanism according to claim 1 wherein the retaining device is mounted for sliding movement inside a formation in the body.

3. A locking mechanism according to claim 2 wherein a hook formation is integrally formed in the body.

4. A locking mechanism according to claim 1 which includes a receiver which detects an externally transmitted signal and, if the signal is verified, causes the actuator to operate.

5. A locking mechanism according to claim 1 which includes a timer which commences a timing period when the retaining device is moved from the first position to the second position and wherein, during the timing period, if the locking member is not moved to the unlocked position then the timer automatically causes the actuator to move the retaining device from the second position to the first position.

* * * * *